US006813360B2

(12) United States Patent
Gentle

(10) Patent No.: US 6,813,360 B2
(45) Date of Patent: Nov. 2, 2004

(54) AUDIO CONFERENCING WITH THREE-DIMENSIONAL AUDIO ENCODING

(75) Inventor: Christopher Reon Gentle, Sydney (AU)

(73) Assignee: Avaya, Inc., Linfield, NJ (US)

( * ) Notice: Subject to any disclaimer, the term of this patent is extended or adjusted under 35 U.S.C. 154(b) by 75 days.

(21) Appl. No.: 10/054,428

(22) Filed: Jan. 22, 2002

(65) Prior Publication Data

US 2003/0138108 A1 Jul. 24, 2003

(51) Int. Cl.[7] ..... H04R 5/00
(52) U.S. Cl. ..... 381/23; 381/17
(58) Field of Search ..... 381/17, 18, 19, 381/22, 23, 303, 306, 307, 310; 709/204

(56) References Cited

U.S. PATENT DOCUMENTS 5,020,098 A 5/1991 Celli
5,734,724 A * 3/1998 Kinoshita ..... 381/17
6,408,327 B1 * 6/2002 McClennon et al. ..... 709/204

* cited by examiner

*Primary Examiner*—Minsun Oh Harvey
(74) *Attorney, Agent, or Firm*—Patton Boggs LLP

(57) ABSTRACT

An apparatus and method for assigning each conferee to a conference a three-dimensional position with respect to a central listening position and the other conferees. Each conferees audio stream is encoded with the assigned three-dimensional position to produce an encoded audio stream corresponding to each conferee. For each conferee, the encoded audio streams of the other conferees are mixed to produce a mixed audio stream wherein the conferee listens to the conference from the central listening position.

3 Claims, 5 Drawing Sheets

AUDIO CONFERENCING WITH THREE-DIMENSIONAL AUDIO ENCODING

FIELD OF THE INVENTION

The invention relates to audio conferencing, and in particular, to audio conferencing including encoding conferee audio with positional data relative to a listening position and mixing the encoded conferee audio streams for transmission to other conferees.

PROBLEM

It is a problem in the field of audio conferencing to prevent mistaking the identity of a conferee that is speaking while also providing a method for mixing the audio stream received from two or more conferees and transmitting the mixed audio stream back to each conferee.

In an analog network conference calls are established by merely adding individual signals together using a conference bridge. If two or more people talk at once, their speech is superposed. Furthermore, an active talker can hear if another conferee begins talking. Naturally, the same technique is used in an early digital switch where the signals are first converted to analog, added, and then converted back to digital.

The process of combining multiple analog signals to form a conference call or function as multiple extensions on a single line can be accomplished by merely bridging the wired pairs together to superimpose the signals. When digitized voice signals are combined to form a conference the signals must be converted to analog so they can be combined on two-wire analog bridges or the digital signals must be routed to a digital conference bridge. The digital conference bridge selectively adds the signals together using digital signal processing and routes separate sums back to the conferees. When a conference includes a larger number of conferees the voices are summed together, making it difficult to distinguish whom is talking unless each conferee knows every other conferee well enough to distinguish between their voices.

A known method of resolving the problem requires active participation of the conferees. One such method requires conferees to introduce themselves at the beginning of the conference call. Each of the other conferees listen to the introductions and are required to remember the individual voices in order to later distinguish between conferees during the conference. This method fails to provide a method for distinguishing between conferees that have similar sounding voices. Another method requiring active participation requires the conferee to state his name before speaking. Even when each conferee remembers to state his or her name prior to speaking, it fails to provide a method for distinguishing between conferees that have the same name. The problems associated with active participation are compounded when the number of conferees to the conference increases.

A telephone conferencing arrangement apparatus is disclosed in Celli, (U.S. Pat. No. 5,020,098) wherein the transmitter and receiver sections of a telephone employ circuitry for an audio signal and a phase signal. Digitized phase data and digitized audio output are multiplexed to produce a single 64 kb/s data stream. At the receiver, a de-multiplexer separates the audio output from the phase data and the audio and the phase data are converted to analog signals. The receiver includes an audio panning amplifier that feeds two audio speakers, such as a left speaker and a right speaker. The phase signal provides the control voltage for the panning amplifier such that the phase signal determines that amount of signal proportionally flowing to the left and the right speaker. Thus, providing a positional representation of each conferee.

While the telephone conferencing arrangement apparatus disclosed in Celli overcomes the problems associated with requiring active participation from the conferees, it produces a phase signal relative to the conferees position with respect to the telephone they are using. A problem arises when more than one conferee is located at the same position relative to their telephone as another conferee. Both will produce the same phase signal, requiring the other conferees to again recognize the voice to distinguish between the two conferees. Another problem arises when one or more conferees change their position relative to the telephone they are using during the conference or when a speaker changes position while speaking. In this scenario, the proportion of the audio signal flowing to the left and the right speaker changes during the conference or while they the participant is speaking.

The methods of distinguishing conferees just described fail to provide a method or apparatus to distinguish conferees without requiring active conferee participation. One method requires conferees to introduce themselves one or more times during the conference while the telephone conferencing arrangement apparatus requires the conferees to remain in one position throughput the duration of the conference.

For these reasons, a need exists for a method of distinguishing between conferees without requiring active participation from the conferees.

SOLUTION

The present audio conferencing with three-dimensional audio encoding overcomes the problems outlined above and advances the art by providing a method for assigning a distinct conference position to each conferee and then using the distinct position to encode the audio stream from the corresponding conferee for use with equipment that is capable of reproducing a three-dimensional or a stereo audio stream.

As each conferee is connected to the conference, the conferee is assigned a listening position relative to other conferees in a first audio image. Then the conferee is assigned a three-dimensional position with respect to each of the another conferee as the listener in another audio image. The number of audio images required is equal to the number of conferees. Each audio image having a different one of the conferees in the listening position with the remaining conferees assigned three-dimensional positions around the listener.

An audio mixer produces an audio stream that is different for each conferee, using the three-dimensional position assigned for each audio image. For a conference having three conferees, three audio images are assigned. The first conferee is the listener in the first audio image and the second and third conferees are assigned three-dimensional positions relative to the first conferee as listener. The second audio image has the second conferee as listener and the first and the third conferees assigned three-dimensional positions relative to the second conferee as listener. The third audio image is likewise configured with the third conferee as listener.

During the conference, three mixed audio streams are generated following the audio images. The first mixed audio stream includes audio from the second and third conferees each encoded with the three-dimensional position assigned in the first audio image. Likewise, mixed audio streams are generated for the second conferee by mixing encoded audio from the first and the third conferee, and so on.

The mixed audio streams that are generated each include one of the conferees in a listening position. In other words, all conferees will listen as though they were located within the center of the conference with the other conferees located in positions around the center. Each conferee receives a mixed audio stream comprising a mix of encoded audio streams from the other conferees and each conferee listens to the corresponding mixed audio stream relative to the a listening position.

DETAILED DESCRIPTION

The present audio conferencing with three-dimensional audio encoding summarized above and defined by the enumerated claims may be better understood by referring to the following detailed description, which should be read in conjunction with the accompanying drawings. This detailed description of the preferred embodiment is not intended to limit the enumerated claims, but to serve as a particular example thereof. In addition, the phraseology and terminology employed herein is for the purpose of description, and not of limitation.

Figure 1:
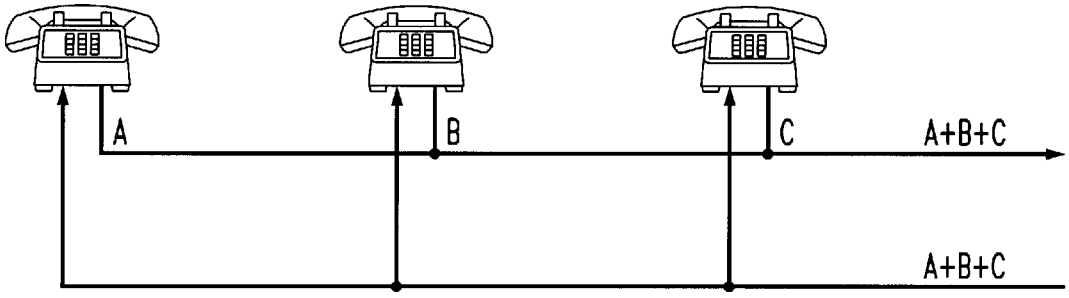
FIG. 1 PRIOR ART
FIG. 1 illustrates an analog conference connection of the prior art.
Figure 2:
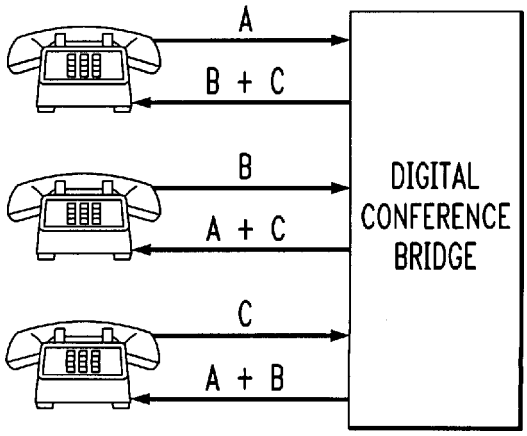
FIG. 2 PRIOR ART
FIG. 2 illustrates a digital conference connection of the prior art.

Prior Art Audio Conferencing—FIGS. 1 and 2

In an analog network conference calls are established by merely adding individual signals together using a conference bridge. If two or more people talk at once, their speech is superposed. Furthermore, an active talker can hear if another conferee begins talking. Naturally, the same technique is used in a digital switch where the signals are first converted to analog, added, and then converted back to digital.

The process of combining multiple analog signals to form a conference call or function as multiple extensions on a single line can be accomplished by merely bridging the wired pairs together as shown in FIG. 1, to superimpose the signals. When digitized voice signals are combined to form a conference the signals must be converted to analog so they can be combined on two-wire analog bridges or the digital signals must be routed to a digital conference bridge as illustrated in FIG. 2. The digital bridge selectively adds the four signals together using digital signal processing and routes separate sums back to the conferees as shown. When a conference includes a larger number of conferees the voices are summed together, making it difficult to distinguish whom is talking unless each conferee knows every other conferee well enough to distinguish between their voices.

Figure 3:
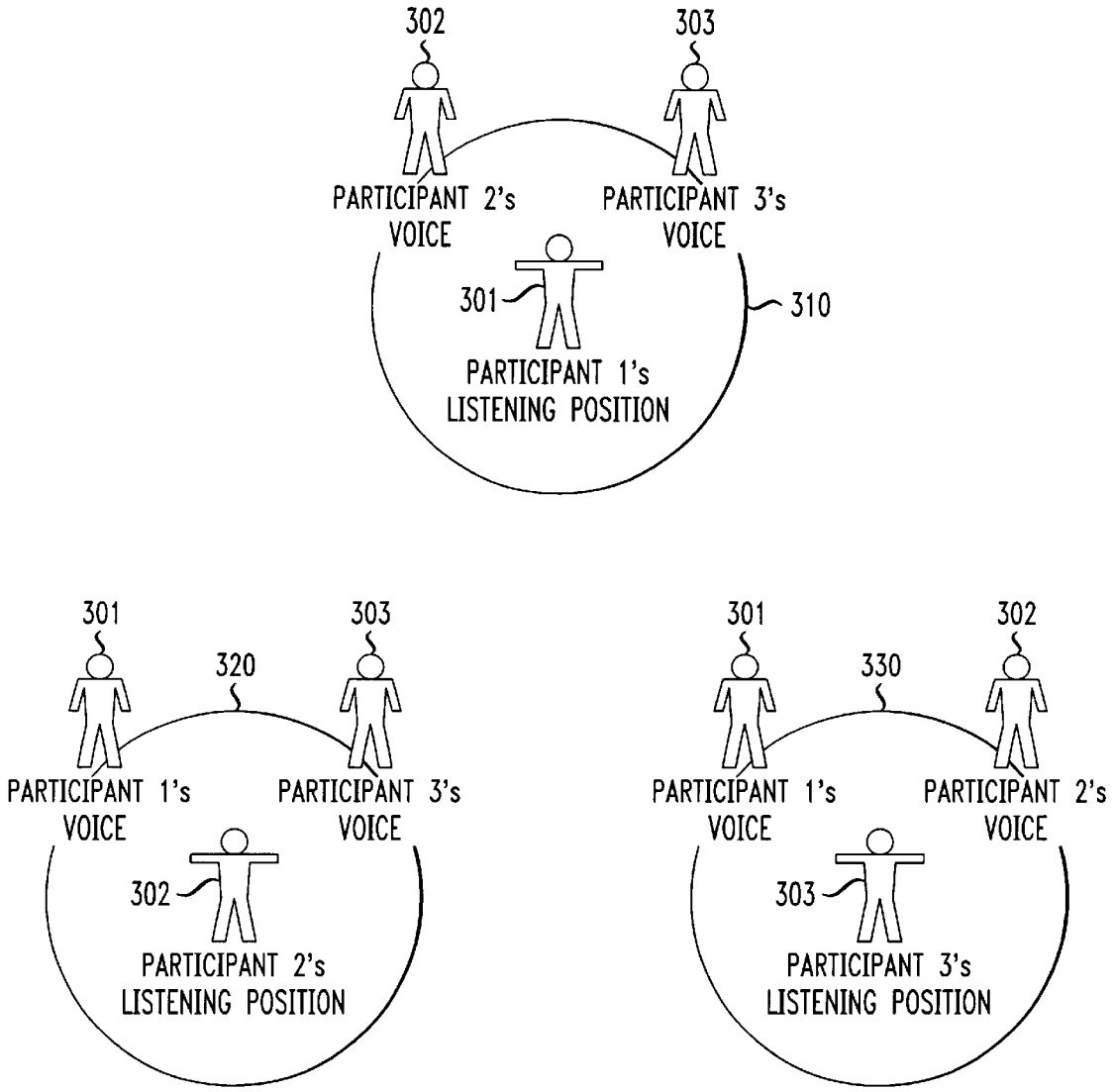
FIG. 3 illustrates three audio images produced for an audio conference having three conferees.
Figure 4:
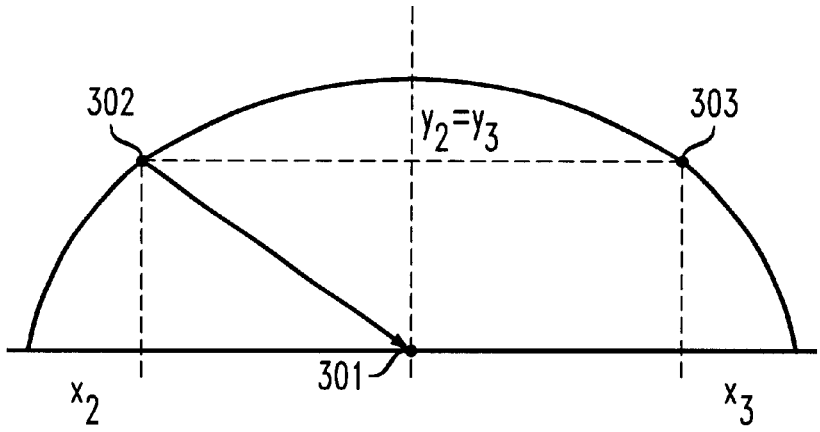
FIG. 4 illustrates a graphical representation of the three-dimensional audio image of FIG. 3.
Figure 5:
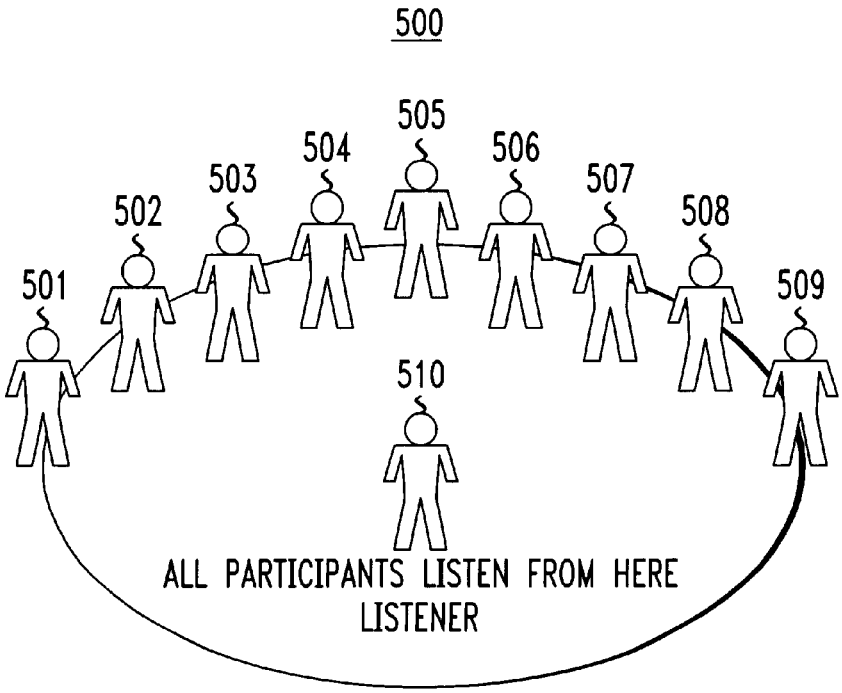
FIG. 5 illustrates a conference having nine conferees assigned three-dimensional positions in reference to a listening position.

Three-dimensional Positioning—FIGS. 3, 4 and 5

The present audio conferencing with three-dimensional audio encoding provides a method for assigning a three-dimensional position to each conferee within the conference for use with conferee equipment that is capable of reproducing a three-dimensional or stereo audio stream. Referring to FIG. 3, conferees are assigned a position relative to a listening position in the center of the conference, creating an audio image for each conferee. For example, a first audio image 310 is created with conferee 301 assigned a listening position with conferee 302 assigned a three-dimensional position to the left and conferee 303 assigned a three-dimensional position to the right. Second audio image 320 includes conferee 302 assigned the listening position with conferee 301 assigned a three-dimensional position to the left and conferee 303 assigned a three-dimensional position to the right. Following the same method, additional audio images are created for each additional conferees.

Creating audio images, conferees 301, 302 and 303 each hear the conference from a corresponding listening position. In other words, conferee 301 listens from the listening position and hears conferee 303 to the right and conferee 302 to the left. Likewise, in audio image 330, conferee 303 listens from the listening position and hears conferee 302 to the right and conferee 301 to the left. As additional conferees are connected to the conference, additional audio images are created for each conferee and each additional conferee is assigned a three-dimensional position within each other audio image.

Each three-dimensional position has an X and a Y component forming a semi-circular conference around the listener. Referring to the graphical illustration in FIG. 4, listener 301 is positioned at the center with the three-dimensional position of 302 and 303 converging toward the center. In this illustration, conferee 302 is positioned a distance X to the left of listener 301 and a distance Y in front of listener 301.

Providing a method of assigning a distinct three-dimensional position to each conferee to a conference provides a method for distinguishing between conferees when one or more conferees are talking. Referring back to FIG. 3, conferee 303 will always hear conferee 301 to the left and conferee 302 to the right. Each time a voice is heard from the right, conferee 303 identifies the position with conferee 302, eliminating the need to identify individual voices. Traditional conference methods merely combined the voices into a single stream. Each conferee either relied on the other conferees to identify themselves or tried to differentiate between the voices. Instead, using the present audio conferencing with three-dimensional audio encoding, each conferee hears each other conferee from a distinct position within the conference when using equipment capable of reproducing a three-dimensional or stereo audio stream. The position of the conferee does not change during the conference, therefore, the conferees can use a combination of voice and position to identify the conferee that is talking.

Providing a method for assigning a distinct three-dimensional position that does not depend on the conferees physical location with respect to the telephone he is using eliminates the need for each conferee to participate by introducing himself or refraining from movement during the conference. It also eliminates the possibility of a conferee's voice from moving from the listener's left ear to the right ear based on the talker's position with respect to his telephone.

Figure 6:
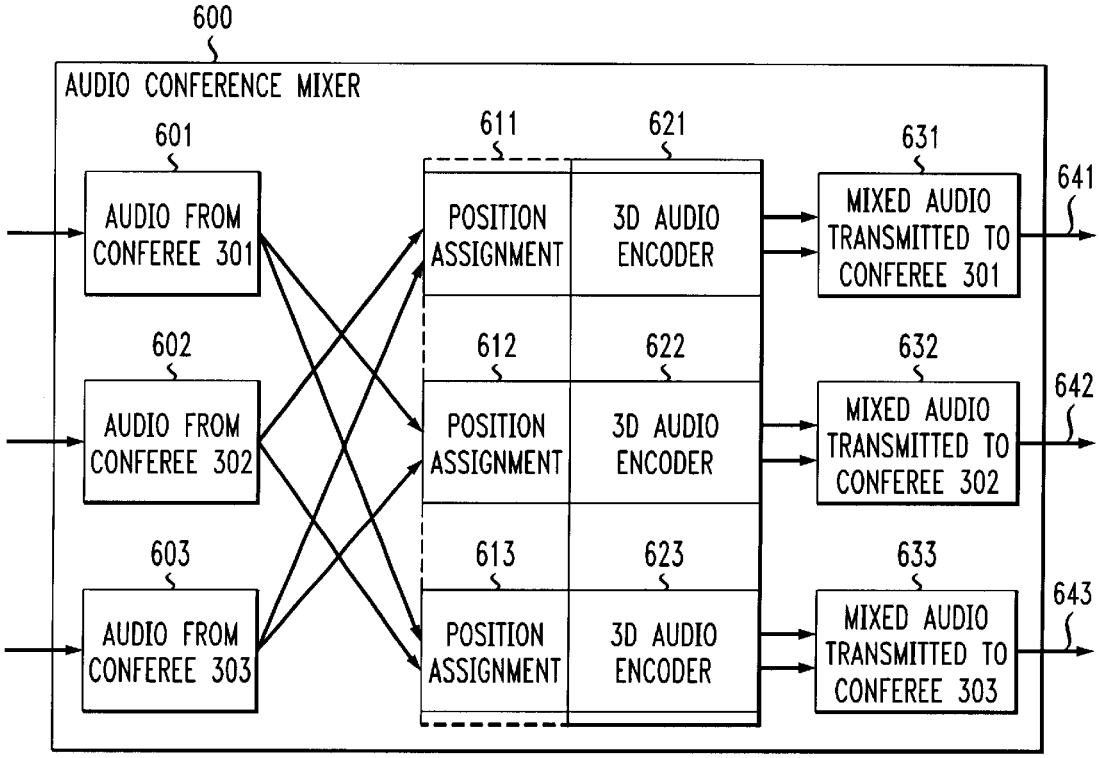
FIG. 6 illustrates an encoding functional flow diagram of the operation of the present audio conferencing with three-dimensional audio encoding.

Conference Operational Characteristics—FIGS. 3 and 6

The present audio conferencing with three-dimensional audio encoding provides a method for distinguishing between conferees. Referring to FIG. 6, audio conference 600 includes audio ports connecting each conferee to the conference, a digital signal processing device including memory (not illustrated) and software necessary to perform in accordance with the following discussion. As conferees are connected to the conference, the conferees are assigned a three-dimensional position with respect to the listening position of each other conferee as previously described and the assigned three-dimensional positions are recorded in position assignment tables 611, 612 and 613. Referring to FIG. 3 in conjunction with the functional block diagram in FIG. 6, audio streams are received from conferees 301, 302 and 303 at audio ports 601, 602 and 603 respectively.

Referring to FIG. 3 in conjunction with the encoding functional flow diagram in FIG. 6, conferee 301 is listener in audio image 310. The audio stream from conferee 302 received at audio port 602 and the audio stream from conferee 303 received at audio port 603 are routed to audio encoder 621 where the audio streams are encoded with three-dimensional position assignments from position assignment table 611. The encoded audio streams are mixed in audio mixer 631 to produce mixed audio stream 641 that is transmitted to conferee 301 during the conference.

Following the same method, audio streams from audio ports 601 and 603 are encoded in audio encoder 622 with assigned three-dimensional positions from position assignment table 612. The encoded audio streams produced in audio encoder 622 are mixed in audio mixer 632 to produce mixed audio stream 642 that is transmitted to conferee 302. Likewise, mixed audio stream 643 is produced by encoding the audio streams from audio ports 601 and 603 and mixing the resulting encoded audio streams from audio encoder 623 in audio mixer 633.

Figure 7:
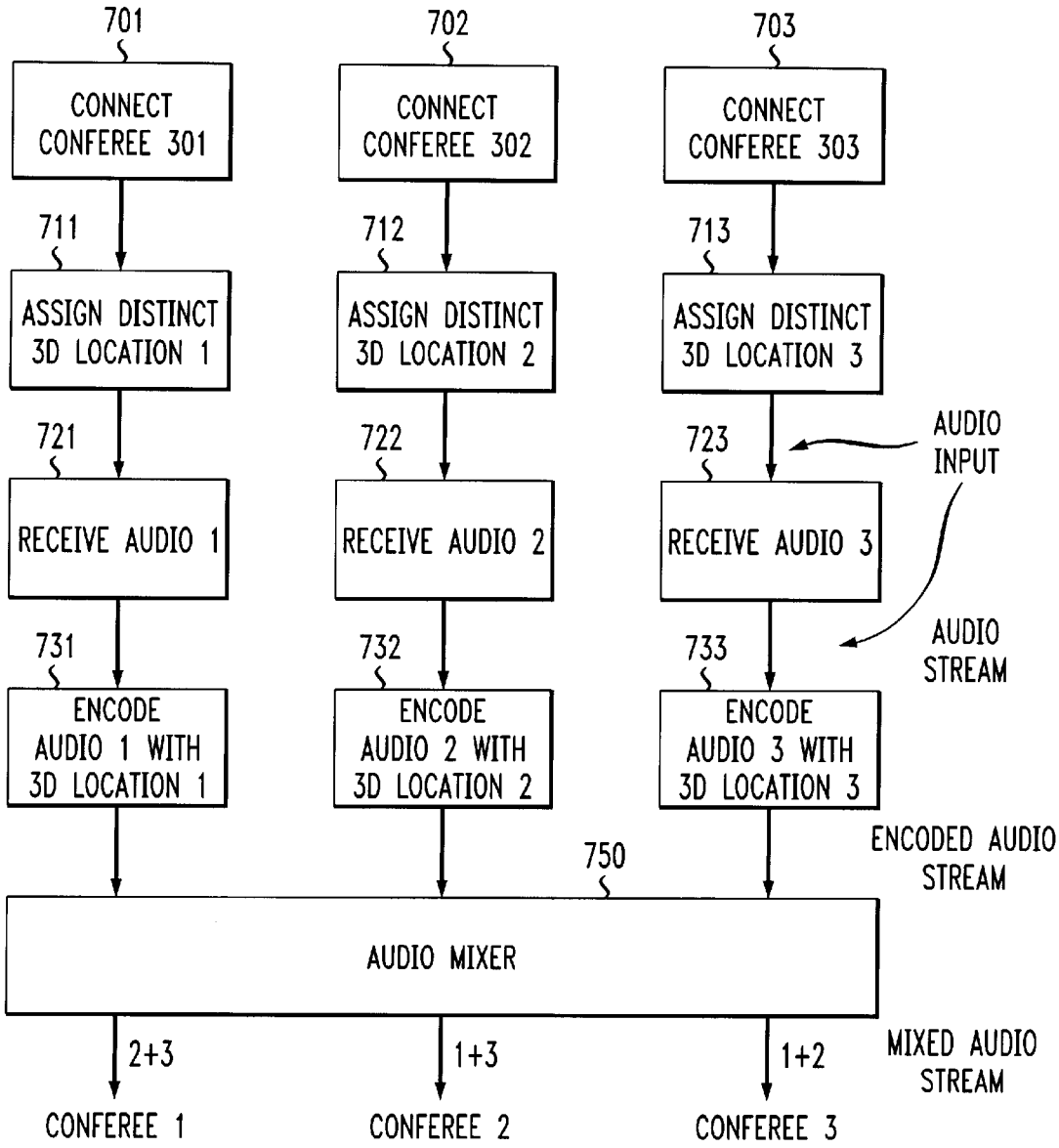
FIG. 7 illustrates an operational flow diagram of the present audio conferencing with three-dimensional encoding.

Referring to FIG. 3 in conjunction with the operational flow diagram of the present audio conferencing with three-dimensional encoding illustrated in FIG. 7, conferee 301 is connected to the conference bridge first in block 701. A distinct three-dimensional position is assigned to conferee 301 in block 711. Conferee 301 is assigned the listening position in audio image 310. When conferees 302 and 303 are connected to the conference in blocks 702 and 703 respectively, they are assigned distinct three-dimensional positions on blocks 712 and 713 with respect to conferee 1 and two new audio images are formed as previously discussed. The assigned three-dimensional positions with respect to each other conferee remains the same for the duration of the conference regardless of the conferees physical position relative to the telephone he is using. As additional conferees join the conference, they are assigned distinct three-dimensional positions with respect to each other conferee and a new audio image is generated for each new conferee.

As an audio stream is received from conferee 303 in block 723, the audio stream is encoded in block 733 with conferee 303's three-dimensional position that was assigned in block 713. The three-dimensional position assigned in block 713 has both an X and a Y component as previously discussed. When the audio stream is encoded with the three-dimensional position in block 733, the resulting encoded audio stream includes an X and a Y positional component.

When audio streams are received from two or more conferees at the same time, each audio stream is encoded with the assigned three-dimensional position. For example, if conferee 301, 302 and 303 talk simultaneously, the audio streams received in blocks 721, 722 and 723 are encoded in blocks 731, 732 and 733 with corresponding three-dimensional positions assigned in blocks 711, 712 and 713 to produce corresponding encoded audio streams. In block 750 the corresponding encoded audio streams are mixed to produce three audio streams, one for each of the conferees in this example. While the operation has been illustrated and discussed with an audio conference having three conferees, a different number of conferees could be substituted.

In an alternative embodiment, one audio image is created such as audio conference 500 illustrated in FIG. 5. In this embodiment, as each successive conferee 501–509 is connected to the conference, each conferee is assigned a single three-dimensional position with respect to a single listening position. Each audio stream is encoded with the corresponding three-dimensional position. Within the audio mixer, a mixed audio stream is generated for each of the conferees. Each mixed audio stream includes a mixture of all of the encoded audio streams except for the audio stream corresponding to the conferee to which the mixed audio stream is being generated.

For example, referring to FIG. 5, each conferee 501–509 is assigned a distinct three-dimensional position with respect to listening position 510. A first mixed audio stream comprising a mix of encoded audio from conferees 502–509 to be transmitted to conferee 501 is generated. Likewise, a mixed audio stream is generated for each conferee comprising each other conferee. In this alternative embodiment, each conferee receives a mixed audio stream comprising encoded audio streams from every other conferee and each conferee listens to the audio conference from listening position 510.

The example illustrated in FIG. 5 involves 9 conferees wherein each conferee is assigned a three-dimensional position to relative to the center listening position 510. In this example, conferee 505 is assigned the distinct three-dimensional position directly in front of listening conferee 510 and therefore is positioned a distance Y (with the X distance=0) in front of listening position 510. In other words, the audio input for each conferee 501–509 is encoded with an X and a Y positional component as though the audio stream were emanating from the assigned distinct three-dimensional position toward listening position 510. The resulting encoded audio streams are mixed to produce a mixed audio stream for each conferee. Using the assigned three-dimensional position, each conferee listens from listening position 510 but talks from the assigned distinct position in reference to each other conferee.

Using the present audio conferencing with three-dimensional audio encoding, each conferee hears each other conferee from a distinct position within the conference when using equipment capable of reproducing a three-dimensional or stereo audio stream. Once a distinct three-dimensional position is assigned to a conferee with respect to each other conferee, that distinct three-dimensional position is used to encode the audio stream of the corresponding conferee for the duration of the conference. Retaining the distinct three-dimensional position of each conferee with respect to each other conferee throughout the duration of the conference provides a method for each conferee to distinguish one conferee from another conferee.

As to alternative embodiments, those skilled in the art will appreciate that the present audio conferencing with three-dimensional audio encoding can be configured with an alternative number of conferees and the center listening position can be substituted with an alternative listening position. Likewise, alternative distinct three-dimensional positions can be assigned to each conferee although the present audio conferencing with three-dimensional audio encoding was illustrated and discussed with conferees 1, 2 and 3 in distinct three-dimensional positions with respect to each other conferee. Thus, the illustrations and discussions with assigned distinct three-dimensional positions within the conference were for illustration only and not intended as a limitation.

It is apparent that there has been described, a audio conferencing with three-dimensional audio encoding, that fully satisfies the objects, aims, and advantages set forth above. While the audio conferencing with three-dimensional audio encoding has been described in conjunction with specific embodiments thereof, it is evident that many alternatives, modifications, and/or variations can be devised by those skilled in the art in light of the foregoing description. Accordingly, this description is intended to embrace all such alternatives, modifications and variations as fall within the spirit and scope of the appended claims.

What is claimed is:

1. A three-dimensional audio conferencing method for distinguishing between two or more conferees for use with equipment capable of reproducing a three-dimensional or stereo audio stream comprising:

for each of said two or more conferees, generating an audio image, where each of said two or more conferees is assigned, respective of the other two or more conferees, a central listening position of said audio image, said other two or more conferees assigned a different three-dimensional position within said audio image respective of said central listening position;

receiving two or more audio streams, wherein each one of said two or more audio streams corresponds to one of said two or more conferees;

encoding said two or more audio streams with said three-dimensional position corresponding to said two or more conferees to produce two or more encoded audio streams;

for each of said two or more conferees, mixing the other two or more encoded audio streams corresponding to the other two or more conferees to produce a listening position mixed audio streams;

for each one of said two or more conferees assigned to said listening position within said corresponding one of said two or more audio images, receiving said listening position mixed audio stream; and reproducing said other two or more mixed audio streams contained in said listening position mixed audio stream on said equipment to reproduce said three-dimensional positions and audio streams of said other two or more conferees, wherein said other two or more mixed audio streams and said three-dimensional positions do not change position during said audio conferencing.

2. A three-dimensional audio conferencing method for distinguishing between two or more conferees for use with equipment capable of reproducing a three-dimensional or stereo audio stream, the method comprising:

connecting said two or more conferees to an audio conference;

assigning a distinct three-dimensional position to each of said two or more conferees to said audio conference, wherein said distinct three-dimensional position is with respect to a listening position;

receiving two or more audio streams, wherein each of said two or more audio streams correspond to one of said two or more conferees;

encoding said two or more audio streams with said distinct three-dimensional position corresponding to said two or more conferees to generate two or more encoded audio streams, wherein each one of said two or more encoded audio streams corresponds to one of said two or more conferees;

for each one of said two or more conferees, mixing said other two or more encoded audio streams to generate a mixed audio stream corresponding to said one of the two or more conferees;

for each one of said two or more conferees, creating an audio images having a listening position and two or more three-dimensional positions with respect to said listening position; and assigning one of said two or more conferees to said listening position within a corresponding one of said two or more audio images; and assigning said other two or more conferees to a corresponding one of said two or more three-dimensional positions within said other two or more audio images, wherein each of said two or more conferees listens to said other two or more conferees from the listening position within said corresponding one of said two or more audio images.

3. An apparatus for three-dimensional audio conferencing for distinguishing between two or more conferees for use with equipment capable of reproducing a stereo audio stream, the apparatus comprising:

a means for generating an audio image, where each of said two or more conferees is assigned, respective of the other two or more conferees, a central listening position of said audio image, said other two or more conferees assigned a different three-dimensional position within said audio image respective of said central listening position;

a means for receiving two or more audio streams from said two or more conferees, wherein each one of said two or more audio streams corresponds to one of said two or more conferees;

for each one of said two or more conferees, a means for assigning one of the two or more conferees to said listening position within a corresponding one of said two or more audio images;

for each of said other two or more conferees, a means for assigning each of said other two or more conferees to said two or more three-dimensional positions within said corresponding one of the two or more audio images;

a means for encoding said two or more audio streams with said corresponding two or more three-dimensional positions assigned to each one of said two or more conferees to produce two or more encoded audio streams;

for each one of said two or more conferees, a means for mixing said other two or more encoded audio streams to produce a mixed audio stream, where each one of said mixed audio streams corresponds to said one of said two or more conferees; and transmitting said corresponding mixed audio stream to each one of said two or more conferees.

* * * * *

UNITED STATES PATENT AND TRADEMARK OFFICE

CERTIFICATE OF CORRECTION

PATENT NO. : 6,813,360 B2
DATED : November 2, 2004
INVENTOR(S) : Christopher Reno Gentle It is certified that error appears in the above-identified patent and that said Letters Patent is hereby corrected as shown below:

Title Page,
Item [73], Assignee, "Avaya, Inc., Linfield, NJ (US)" should read
-- Avaya Technology Corp., Basking Ridge, NJ (US) --

Signed and Sealed this

First Day of February, 2005

JON W. DUDAS
*Director of the United States Patent and Trademark Office*